United States Patent [19]

Rader

[11] 4,009,882

[45] Mar. 1, 1977

[54] THREE-DIMENSIONAL WORD GAME APPARATUS

[76] Inventor: James E. Rader, R.F.D. One, Plainfield, Vt. 05667

[22] Filed: Jan. 5, 1976

[21] Appl. No.: 646,478

Related U.S. Application Data

[63] Continuation-in-part of Ser. No. 494,984, Aug. 5, 1974, Pat. No. 3,930,651.

[52] U.S. Cl. ..... 273/135 D; 273/130 AC; 273/130 E; 273/156

[51] Int. Cl.[2] ..... A63F 3/00

[58] Field of Search ..... 273/130 AC, 130 B, 130 E, 273/131 AC, 131 G, 134 AB, 135 D, 136 W, 156, 157 R

[56] References Cited

UNITED STATES PATENTS

| | | | |
|---|---|---|---|
| 487,063 | 11/1892 | Bailey | 273/156 |
| 2,335,099 | 11/1943 | Barkin | 273/130 E |
| 2,886,325 | 5/1959 | Long | 273/130 E |
| 2,940,760 | 6/1960 | Brinkman, Jr. | 273/130 AC |
| 3,623,729 | 11/1971 | Wetherell | 273/130 AC |
| 3,771,795 | 11/1973 | Flanigen | 273/157 R |

FOREIGN PATENTS OR APPLICATIONS

| | | | |
|---|---|---|---|
| 699,546 | 11/1953 | United Kingdom | 273/130 AC |

*Primary Examiner*—Richard J. Apley
*Assistant Examiner*—Harry G. Strappello
*Attorney, Agent, or Firm*—Berman, Aisenberg & Platt

[57] ABSTRACT

A three-dimensional word game apparatus which includes a cubical solid defining six playing surfaces. Paper pieces or covers having game diagrams and indicia formed thereon are adapted to be positioned upon and to cover the six faces of the cubical solid. The paper pieces or covers may take any of a variety of different shapes and embodiments. One such preferred embodiment has three each of the playing surfaces or areas formed on two substantially rectangular pieces of paper. The three playing surfaces are arranged in an end-to-end fashion, and each piece of paper includes tabs and marking indicia for facilitating attachment of the pieces of paper to one another and to the cubical solid. This embodiment of paper cover facilitates provision of same in a pad-like form. The individual pieces of paper may be mounted to the cubical solid with the aid of an adhesive or retainer clips, and have playing areas and squares adapted to be written or otherwise marked in by the game players.

10 Claims, 8 Drawing Figures

THREE-DIMENSIONAL WORD GAME APPARATUS

CROSS REFERENCE TO RELATED APPLICATION

This application is a continuation-in-part application of Ser. No. 494,984, filed Aug. 5, 1974, U.S. Pat. No. 3,930,651 and copending herewith, entitled THREE-DIMENSIONAL WORD GAME.

BACKGROUND OF THE INVENTION

1. Field of the Invention

This invention relates to games, and more particularly is directed towards a three-dimensional word game apparatus.

2. Description of the Prior Art

The most pertinent prior art known to me is that cited in the file of my copending patent application Ser. No. 494,984, of which the instant application is a continuation-in-part.

To elucidate, my copending application teaches a three-dimensional word game which comprises in the preferred form a 3 × 3 × 3 cube for receiving letter pieces, there being 26 letter-receiving spaces disposed on the surface of the cube. In playing the game, players take turns placing one or more letter pieces onto the cube. Words are formed by tracing a path between consecutively adjacent letter pieces. Two letter pieces are said to be "adjacent" if any of their respective exposed faces adjoin either side-to-side or corner-to-corner when they have been played onto the cubical rack. By "consecutively" is meant that, in order for a word to be spelled out, its first letter must be adjacent to its second, its second must be adjacent to its third, and so on. These concepts are illustrated in great detail in my copending application, the entire disclosure of which is incorporated herein by reference.

Although the particular embodiment of the cubical rack and associated letter pieces described in my copending application is rather unique, I have found that the letter-placing aspects of the invention described therein may take the form of other and equally suitable embodiments. It is to such alternative embodiments that the instant application is addressed.

OBJECTS AND SUMMARY OF THE INVENTION

It is therefore a primary object of the present invention to provide a new and improved three-dimensional word game apparatus.

Another object of the invention is to provide a three-dimensional word game apparatus which is less expensive than the type set forth in my copending application referred to hereinabove and is therefore more attractive to potential users.

A still further object of the present invention is to provide a three-dimensional word game apparatus which is easy to manufacture, is simple to use, and lends itself to the same infinite variety of possibilities as do the concepts originally described in my copending application.

A more particular object of the present invention is to provide a three-dimensional word game apparatus by means of which the play of the game may be recorded in a permanent or disposable fashion upon pieces of paper having the unique indicia layout formed thereon to dispense with the requirement for individual letter pieces.

The foregoing and other objects are attained in accordance with one aspect of the present invention through the provision of a three-dimensional word game apparatus which comprises a cubical solid having six faces defining respectively six playing surfaces. Paper means are provided upon which is formed indicia indicative of six playing surfaces or areas, each of said playing areas including a plurality of playing spaces some of which are unique to that playing area and some of which traverse the boundaries between that playing area and one or two adjoining playing areas. The paper means further include location identification indicia which uniquely identify each of the plurality of playing spaces. Further, the paper means are sized such that each of the six individual playing areas covers respectively each of the six corresponding faces of the cubical solid. The three-dimensional word game apparatus may be provided with means for supporting the cubical solid on an edge thereof such that each of the six faces may be rendered easily accessible to a user or player of the game. The support means, in its simplest form, may comprise a spindle positioned through a diagonally formed aperture opening along an edge of the cube. Means may also be provided, such as spring clips, for holding the paper means against the six faces of the cubical solid during the play of the game.

In accordance with still other aspects of the present invention, the paper means comprises a pair of substantially square pieces of paper, each of the pieces having four equal quadrants delineated on one side thereof. Three of the four quadrants on each of the pieces of paper are respectively comprised of three of the six individual playing areas, while the fourth quadrant is substantially unused and may be blank. The fourth quadrant is utilized for folding and installation of the pieces of paper onto the cubical solid.

In accordance with still other aspects of the present invention, the paper means comprises a pair of substantially rectangular pieces of paper, each of the pieces having three equal sections placed in an end-to-end relationship and delineated on one side of each piece. The three equal sections are respectively comprised of three of the six individual playing areas of the paper means, the remaining three playing areas being defined on the other piece of paper. Each of the rectangular pieces may have formed thereon indicia and tabs which facilitate the attachment of the pieces to one another or to the cubical solid during their installation onto the cubical solid.

In accordance with other aspects of the present invention, the paper means may comprise a single piece of paper having six equal areas delineated on one side thereof, the six equal areas being positioned such that the piece of paper may be fittingly wrapped about the cubical solid. For example, the six equal areas may be shaped in a T-configuration, or the like.

In accordance with still another aspect of the present invention, the paper means may be comprised of six individual pieces of substantially square paper, each individual pieces having indicia formed thereon corresponding to one of the six individual playing areas and adapted to be positioned over one of the six faces of the cubical solid. This embodiment lends itself to provision of the six pieces of paper in a pad-like form such that they may be readily manufactured and easily provided with the cubical solid upon which they are to be placed.

BRIEF DESCRIPTION OF THE DRAWINGS

Various objects, aspects, features, and attendant advantages of the present invention will be more fully appreciated as the same becomes better understood when considered in ligh of the following detailed description of the present invention viewed in conjunction with the accompanying drawings, in which.

DETAILED DESCRIPTION OF THE PREFERRED EMBODIMENTS

Figure 1:
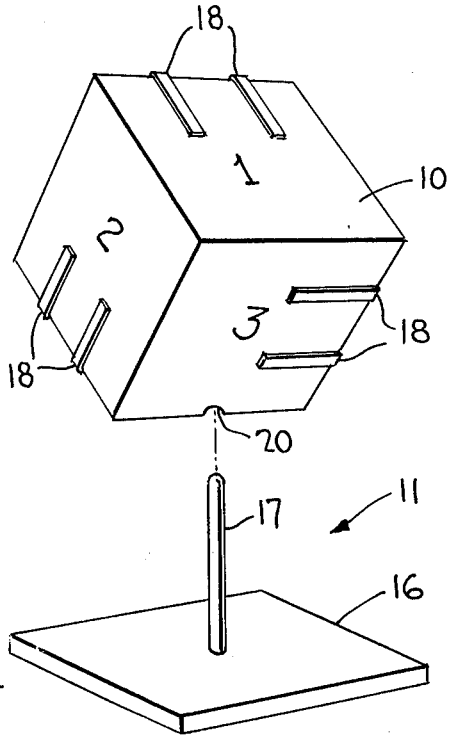
FIG. 1 is a plan view illustrating a preferred embodiment of the cubical solid and associated stand in accordance with the present invention.

Referring now to the drawings, wherein like reference numerals designate identical or corresponding parts throughout the several views, and more particularly to FIG. 1 thereof, there is illustrated in general schematic form a preferred embodiment of the cubical word game apparatus of the present invention.

The cubical word game apparatus comprises a cubical solid 10 having six faces, three of which are identified in FIG. 1 with the numerals 1, 2 and 3, the three sides not shown in this view having the numerals 4, 5, and 6, placed thereon for identification purposes for the players, as will become more clear hereinafter.

Cubical solid 10 may be made of wood, plastic, or other suitable material and is designed to hold a piece or pieces of paper pre-printed with the game diagram, as will become more clear hereinafter. In this connection there may be provided a plurality of spring clips 18 positioned along peripheral edges of each of the two sets of mutually-adjacent faces 1, 2, 3, and 4, 5, 6 of the cubical solid 10 to hold the game diagram pieces of paper in position thereon. Obviously, clips 18 are only one form of retaining means which may be utilized within the spirit and scope of the present invention.

A stand 11 may also be provided for holding the cubical solid 10 while the game is being played. In FIG. 1, stand 11 comprises a substantially planar base member 16 having a spindle 17 extending upwardly therefrom. Formed diagonally within cubical solid 10 and opening along the lower edge thereof as viewed in FIG. 1 is a spindle-receiving aperture 20 through which the spindle 17 may be positioned for retaining cube 10 in an upright, accessible position and for permitting it to be rotated freely during the play of the game.

Figure 2:
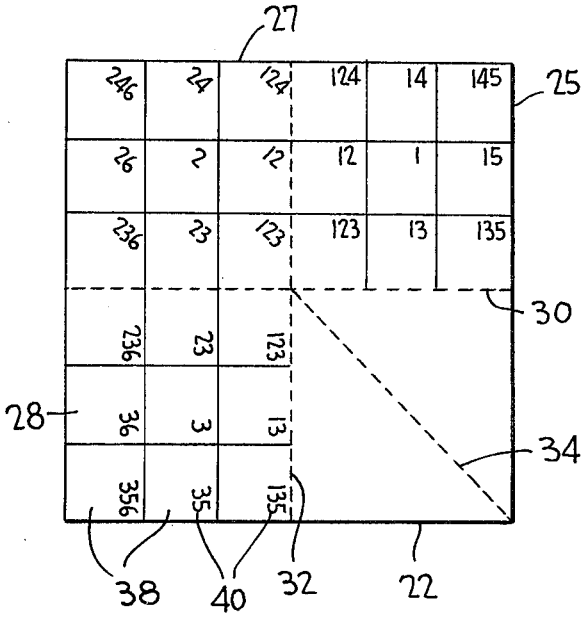
FIG. 2 is a top view illustrating one of the preferred embodiments of the paper means adapted to be fitted about the cubical solid of FIG. 1.

Referring now to FIG. 2, there is illustrated one preferred embodiment of a game diagram paper piece or cover upon which are disposed various indicia to be explained hereinafter. The paper piece or cover illustrated in FIG. 2 is substantially square in shape and is divided into four equal quadrants 22, 25, 27 and 28. Quadrant 22 may be substantially blank as shown, but for a dotted line 34 which assists in the folding and installation thereof onto the cubical solid 10 of FIG. 1. Quadrants 25, 27 and 28 are adpated to be mounted upon faces 1, 2 and 3 of the cubical solid 10 illustrated in FIG. 1.

Each of the three quadrants 23, 27 and 28 is comprised of a plurality, in this example nine, individual squares 38, each of which squares 38 comprises a playing space either by itself or in combination with one or two other squares 38 located on one or two quadrants that adjoin it when it is mounted on the cubical solid 10, and each of which squares 38 has imprinted in a corner thereof a location identification index 40 unique to that playing space. The particular index notation utilized in the paper cover illustrated in FIG. 2 corresponds to that notation explained in my copending application referred to hereinabove. Briefly, the individual playing space or square at the center of each quadrant is designated by the corresponding number of the face of the cube 10 upon which it is to be positioned. In other words, within quadrant 25 is centrally located a playing space having the designation 1 in the upper righthand corner, which will refer to the playing space to be placed at the center of face 1 of cube 10 in FIG. 1. An edge playing space is identified by a two-digit number whose digits indicate the two faces of the cube 10 on which it appears. For example, playing space 12 is the playing space which traverses the boundary edge between face 1 and face 2. Similarly, playing space 23 is the playing space at the intersection of faces 2 and 3. A similar notation is utilized for corner playing spaces which are identified by a three-digit number. For example, playing space 124 is the playing space at the upper right corner in FIG. 2 of quadrant 27 which is defined by the intersection of faces 1, 2 and 4 (not shown).

In installing the paper cover illustrated in FIG. 2 onto faces 1, 2 and 3 of cube 10 in FIG. 1, the paper would be folded along the two dotted lines 30 and 32 which may be pre-folded or creased as desired. Folded in the opposite direction to lines 30 and 32 would be diagonal dotted line 34 by virtue of which quadrant 22 would be inwardly folded and tucked under either quadrant 28 or 25 in the installation of the paper cover of FIG. 2 onto cubical solid 10. Again, it should be understood that another paper cover similar to that illustrated in FIG. 2, but having indicia 40 corresponding to faces 4, 5 and 6 of cubical solid 10, is necessary but is not shown.

Figure 3:
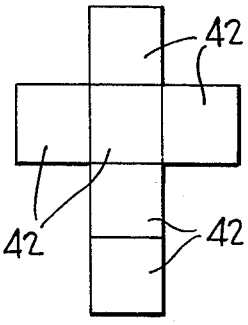
FIGS. 3 through 6 each illustrates a different embodiment of the paper means for fittable mounting upon the surfaces of the cubical solid of the present invention; and FIGS. *7a* and *7b* are detailed illustrations of yet another embodiment of the paper means which are adapted to be fastened first to one another and then to the cubical solid in accordance with the teachings of the present invention.
Figure 4:
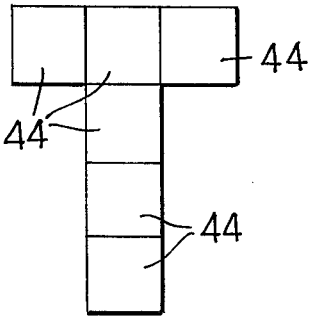
Figure 5:
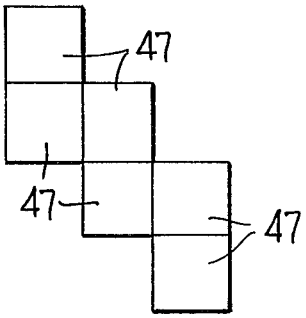

FIGS. 3 through 5 each illustrate alternative embodiments of game diagram paper covers which may be manufactured for use in connection with the cubical game apparatus of the present invention. For clarity, the individual squares or playing spaces 38 and their respective location indicia 40 have been omitted in FIGS. 3 through 5. Appropriate alternative arrangements of spring clips 18, as in FIG. 1, or other means may be provided for use in securing these various paper covers to the cubical solid 10. Alternatively, the paper covers may be equipped with tabs and adhesive for attachment to one another or to the cubical solid 10 during installation on said cubical solid 10. In such case, the spring clips 18 may be dispensed with. If the paper cover is made of a sufficiently still material, such as carboard, the cubical solid 10 itself may be dispensed with since the paper cover would provide a self-supporting cubical structure.

Figure 6:
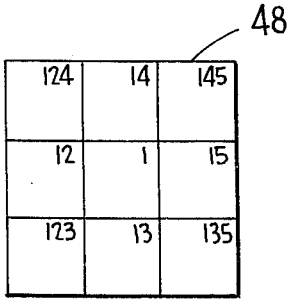

FIG. 3 illustrates the six faces 42 of a cross-shaped game diagram paper piece, FIG. 4 illustrates the six faces 44 of a T-shaped game diagram paper piece, while FIG. 5 illustrates the six faces 47 of a staircase-shaped game diagram paper piece. These particular embodiments of game diagram paper pieces are provided for illustrative purposes only, since it is obvious that other shapes of paper covers in which the six faces are arranged in side-to-side, hexomino fashion would be equally suitable for producing a single sheet of paper which will cover the six faces of cubical solid 10. FIG. 6 illustrates an alternate form of paper piece which may be utilized in conjunction with the apparatus shown in FIG. 1. FIG. 6 comprises a one-face game diagram paper piece 48 for individual attachment to one face of the cubical solid 10. The particular face of the diagram pictured in FIG. 6 is that of quadrant 25 of FIG. 2, which is adapted to be mounted upon face 1 of the cubical solid 10 in FIG. 1. It is apparent that six of such paper pieces 48, each corresponding to a different face of the cubical solid 10, are required for a full playing of the word game. Additional spring clips 18, as in FIG. 1, or alternative means such as U-shaped slide-in brackets, may be provided on the cubical solid 10 for securing sheets 48 or pads of sheets 48 to the faces of the cubical solid 10. The beauty of the embodiments illustrated in FIGS. 2 and 6 is that they may be easily provided on a pad and thereby readily mass produced without paper waste or without requiring complicated cutting of paper, as may be required in connection with the FIGS. 3 through 5 embodiments.

Figure 7A:
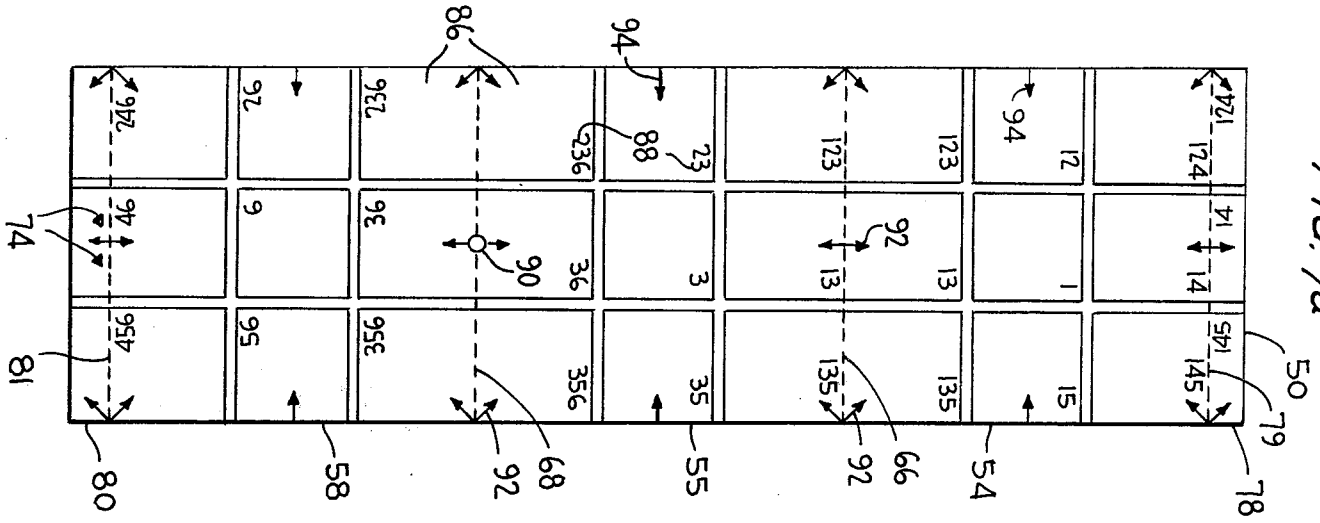
Figure 7B:
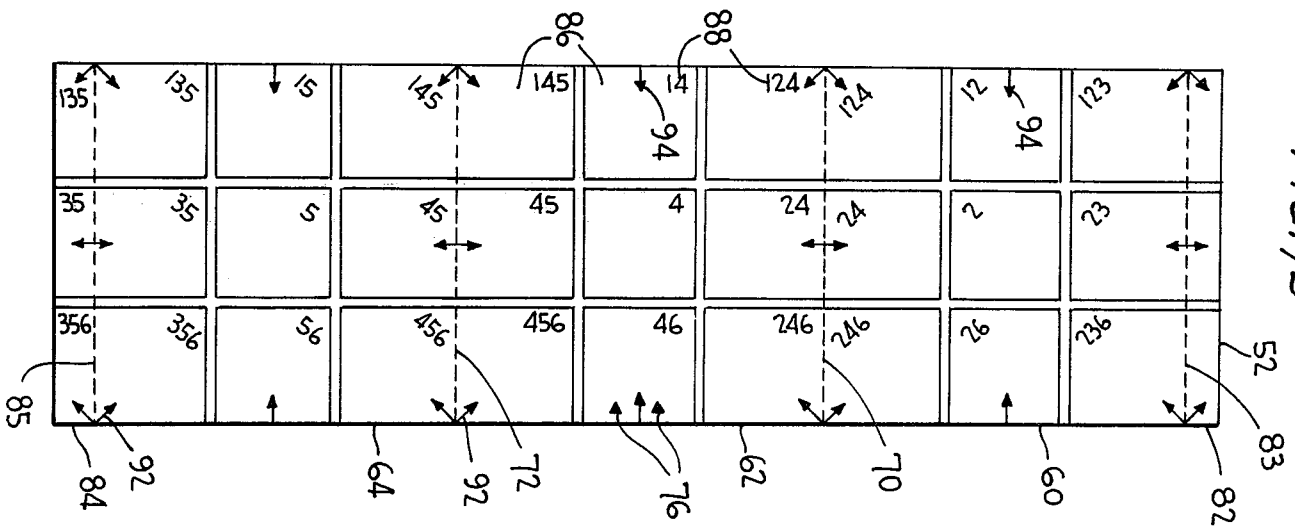

Referring now to FIGS. 7*a* and 7*b*, there is illustrated a still further alternative but preferred embodiment of a pair of paper strips 50 and 52 having game playing indicia formed thereon. Each paper strip 50 and 52, which may obviously be conveniently provided in a pad-like form, includes three playing areas.

Strip 50 includes playing areas 54, 55 and 58, while strip 52 has playing areas 60, 62 and 64 formed thereon in an end-to-end elongate relationship. Strip 50 further includes folding marks such as dotted lines 66 and 68 positioned intermediate the edges of playing areas 54, 55 and 58. Similarly, paper strip 52 has dotted lines 70 and 72 to assist in the folding thereof before placement on the cubical solid 10 of FIG. 1.

Formed at the respective ends of sheets 50 and 52, are attaching tabs 78, 80, 82 and 84 which are delineated by folding marks in the form of dotted lines 79, 81, 83, and 85. Adhesive may be applied to these attaching tabs for use in installing sheets 50 and 52 around the cubical solid 10. Reference numerals 86 connotate individual playing squares, while reference numerals 88 designate the individual location identification indicia, similar to that set forth wigh respect to FIG. 2.

Provided intermediate playing areas 55 and 58 along dotted line 68 is an aperture 90 for accommodating the spindle 17 once the pieces 50 and 52 have been placed about cubical solid 10. The design of the strips 50 and 52 further includes a plurality of particularly positioned double arrow reminder markers 92, as well as a plurality of strategically located single arrow reminder markers 94.

Two aligning triangular marks 74 are positioned on attaching tab 80 of sheet 50, while similar aligning triangular marks 76 are positioned in square 46 of quadrant 62 of sheet 52. These marks 74 and 76 are aligned during the installation of sheets 50 and 52 whereby tab 80 may be placed over or under the adjacent edge of quadrant 62 and attached so as to form a T-shaped paper cover, similar to that illustrated in FIG. 4. Thereafter, after the cubical solid 10 is removed from stand 11, the T-shaped paper cover may be placed face down while the spindle 17 is placed through the aperture 90 in strip 50. The cubical solid may then be repositioned on spindle 17. The T-shaped cover may then be readily fastened to the remainder of the cubical solid by appropriate adhesive placed on the remaining tabs 78, 82 and 84.

While suitable arrangements of spring clips 18, as in FIG. 1, might be used in securing the paper strips 50 and 52 to the cubical solid 10, in the preferred embodiment the paper strips 50 and 52 are designed to be attached with appropriate adhesive to one another or directly to the cubical solid 10. In such case the spring clips 18 could be dispensed with. If the paper strips 50 and 52 were made of a sufficiently stiff material, such as cardboard, the cubical solid 10 itself may be dispensed with as the paper strips 50 and 52 would provide a self-supporting cubical structure.

While the particular game-playing rules of the instant invention are more particularly set forth in my copending application described hereinabove, briefly, for the sake of completeness, during the playing of a game, letters are written into the individual playing squares 86 with a pencil, pen, or other suitable marker. According to the preferred rules, each letter would be used or played only once. The letter being played would be written only once in a face playing space or square (for example, square 1 or square 5), but the same letter would be written twice (once on each of the two faces involved) in an edge playing space (for example, space 13 or space 56). Similarly, the same letter would be written three times in a corner playing space (for example, space 123 space 356). The double arrow reminder markers 92 and single arrow reminder markers 94 are provided at the edges and corners of the faces of the paper cover in order to remind a player to write the letter a sufficient number of times in such cases.

Numerous modifications and variations of the present invention are possible in light of the above teachings. It is therefore to be understood that within the scope of the appended claims, the invention may be practiced otherwise than as specifically described herein.

I claim as my invention:

1. A three-dimensional word game apparatus, which comprises:

a cubical solid having six faces defining respectively six different playing surfaces; and paper means upon which is formed indicia indicative of six individual playing areas, each area including a plurality of playing spaces, and location identification indicia uniquely identifying each of said plurality of playing spaces, said paper means sized such that each of said six individual playing areas covers respectively each of said six faces of said cubical solid.

2. The three-dimensional word game apparatus as set forth in claim 1, further comprising means for supporting said cubical solid on an edge thereof whereby each of said six faces thereof is made accessible to a user.

3. The three-dimensional word game apparatus as set forth in claim 1, further comprising means for holding said paper means against said six faces of said cubical solid.

4. The three-dimensional word game apparatus as set forth in claim 3, wherein said holding means comprises a plurality of spring clips placed upon edges of said cubical solid to hold said paper means when the latter is properly positioned thereon.

5. The three-dimensional word game apparatus as set forth in claim 1, wherein said paper means comprises a pair of substantially square pieces of paper, each of said pieces having four equal quadrants delineated on one side thereof.

6. The three-dimensional word game apparatus as set forth in claim 5 wherein three of said four quadrants on each of said pieces of paper are respectively comprised of three of said six individual playing areas, the fourth quadrant being substantially unused but for folding and installation of said pieces of paper.

7. The three-dimensional word game apparatus as set forth in claim 1 wherein said paper means comprises a pair of substantially rectangular pieces of paper, each of said pieces having three equal sections delineated on one side thereof which respectively comprise three of said six individual playing areas of said paper means.

8. The three-dimensional word game apparatus as set forth in claim 7 wherein each of said pieces of paper further has formed thereon indicia means and tab means for facilitating attachment to one another or to said cubical solid.

9. The three-dimensional word game apparatus as set forth in claim 1 wherein said paper means comprises a single piece of paper having six equal areas delineated on one side thereof, said six equal areas being positioned such that said piece of paper may be wrapped and fit about said cubical solid.

10. The three-dimensional word game apparatus as set forth in claim 1 wherein said paper means comprises six individual pieces of substantially square paper, an individual piece having indicia formed thereon corresponding to one of said six individual playing areas and adapted to be positioned over one of said six faces of said cubical solid.

* * * * *